US007169120B2

(12) United States Patent
Murdock et al.

(10) Patent No.: US 7,169,120 B2
(45) Date of Patent: Jan. 30, 2007

(54) DEVICE AND METHOD FOR PROVIDING A MASSAGE

(76) Inventors: Matthew L. Murdock, 8905 W. Cambridge Ave., Phoenix, AZ (US) 85037; Mark H. Neidich, 4137 E. Alan La., Phoenix, AZ (US) 85028

( * ) Notice: Subject to any disclaimer, the term of this patent is extended or adjusted under 35 U.S.C. 154(b) by 0 days.

(21) Appl. No.: 10/538,238

(22) PCT Filed: May 11, 2005

(86) PCT No.: PCT/US2005/016430

§ 371 (c)(1),
(2), (4) Date: Jun. 9, 2005

(87) PCT Pub. No.: WO2005/110330

PCT Pub. Date: May 11, 2005

(65) Prior Publication Data

US 2006/0155225 A1 Jul. 13, 2006

Related U.S. Application Data

(60) Provisional application No. 60/570,683, filed on May 11, 2004.

(51) Int. Cl.
*A61H 15/00* (2006.01)

(52) U.S. Cl. ..... 601/129; 601/137

(58) Field of Classification Search ..... 601/118, 601/128, 129, 130, 134–137
See application file for complete search history.

(56) References Cited

U.S. PATENT DOCUMENTS

| | | | | |
|---|---|---|---|---|
| 693,064 | A * | 2/1902 | Proben | 601/129 |
| 4,169,466 | A * | 10/1979 | Wong | 601/131 |
| 5,792,081 | A * | 8/1998 | Cross | 601/123 |
| 6,241,696 | B1 * | 6/2001 | York | 601/137 |
| 6,245,031 | B1 * | 6/2001 | Pearson | 601/118 |

* cited by examiner

*Primary Examiner*—Michael A. Brown
(74) *Attorney, Agent, or Firm*—Schmeiser, Olsen & Watts LLP

(57) ABSTRACT

A handheld massage device has a body including a handle portion and a head portion forming a socket in which a roller ball is removably received. The user can provide increased pressure and can better control a motion during a massage by way of the device. A rolling aspect of the roller ball provides a distinctive massage, especially when a ball of a predetermined size, material, and/or other physical characteristics is used in the device. The massage device may include a set of roller balls, and the method may include selecting a roller ball from the set based on one or more desired characteristic and/or associated therapeutic property to impart a particular healing or other benefit to the subject person.

6 Claims, 4 Drawing Sheets

300

| STONE | METAPHYSICAL PROPERTIES | HEALING PROPERTIES | ASTROLOGICAL SIGN |
|---|---|---|---|
| AMETHYST | SEDATIVE ENERGY, SPIRITUALITY. PEACE | ADDICTIONS, MEDICATION | AQUARIUS, PISCES, VIRGO, CAPRICORN |
| AVENTURINE | INDEPENDENCE, LEADERSHIP, CREATIVITY | GOOD FORTUNE | ARIES |
| HEMATILE | EXCELLENT FOR THE MIND, GROUNDING | CIRCULATION. BLOOD STREAM. | AQUARIUS, ARIES |
| QUARTZ CRYSTAL | UNIVERSAL. CLARITY OF CONSCIOUSNESS. | MENTAL CLARITY. MEDITATION | ALL SIGNS |
| ROSE QUARTZ | LOVE, COMPASSION, FORGIVENESS, HARMONY | CLEARS STORED ANGER, RESENTMENT, JEALOUSY, FEARS | LIBRA, TAURUS |
| SODALITE | LOGIC, EFFICIENCY, TRUTHFULNESS | DIGESTIVE SYSTEM. HARMONY | SAGITTARIUS |
| TIGER EYE | OPTIMISM, INSIGHT, PERSONAL POWER | PHYSICAL LOVE | CAPRICORN |
| UNAKITE | EMOTIONAL BALANCE | HEALTHY REPRODUCTIVE SYSTEM | SCORPIO |

303

FIG. 13

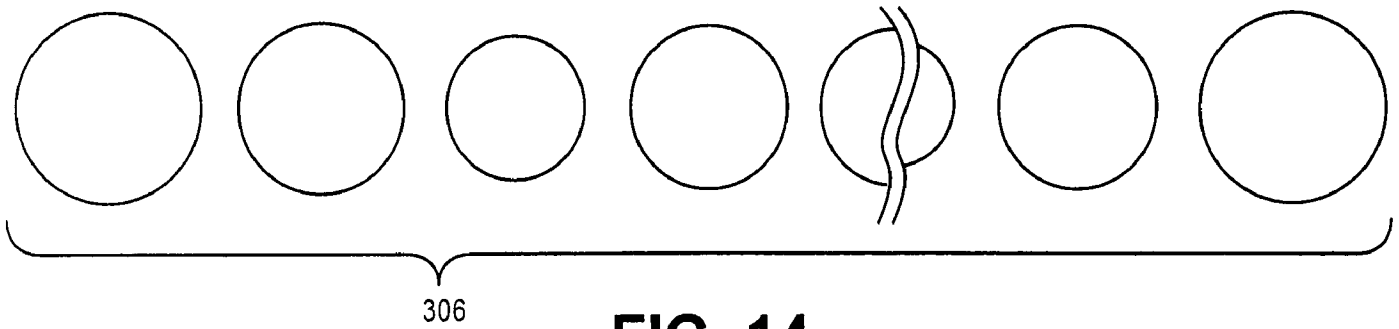

FIG. 14

DEVICE AND METHOD FOR PROVIDING A MASSAGE

This application claims priority to U.S. Provisional Patent Application Ser. No. 60/570,683 filed May 11, 2004, entitled MASSAGE DEVICE, by Matthew L. Murdock, the disclosure of which is incorporated herein by reference.

BACKGROUND OF THE INVENTION

1. Technical Field

This invention generally relates to devices and methods for imparting massages, and more particularly to a hand held device and methods for massaging a subject body.

2. State of the Art

Massage therapy has existed for a long time. Hand massage, massage by manual tools, and massage by automatic tools, which may include vibration and/or kneading capabilities, are well known. Many of these tools and methods utilize rubbing, kneading, and/or acupressure.

A large variety of objects have been used to engage a subject body to apply the rubbing or acupressure desired. Various combinations of balls have been used in massage tools to impart various respective engagement results on the subject body.

Heating of objects to be engaged on a subject body is also known. A variety of therapies have become popular in recent years. These therapies include Acupressure, Cranio-Sacral, Deep Tissue, and Swedish therapies. The Swedish therapies include Effleurage, Friction, and Petrissage therapies. Some additional special therapies include Myofascial Release, Reflexology, the Rosen Method, Shiatsu, Tapotement, Trigger Point Therapy, and Hot Stone Therapy.

DISCLOSURE OF THE INVENTION

This invention generally relates to devices and methods for imparting massages, and more particularly to a hand held device and methods for massaging a subject body. In a simple form, a massage tool in accordance with the present invention may include a body including a handle portion and a head portion. The body may include an interior surface forming a socket in the body. The tool may include a plurality of spherical elements selectively supported in the socket. The spherical elements may have a variety of respective physical characteristics that are selectively incorporated in the tool when a particular one of the spherical elements is supported in the socket. Among other physical characteristics, the spherical elements may include a variety of precious or semi precious stones. The spherical elements may also have a variety of sizes.

In another simple form, the socket of a massage tool in accordance with the present invention may have a back side and a front side with the front side extending in a direction opposite to the back side. A first portion of the interior surface may form a first opening through the front side, and a second portion of the interior surface may form a second opening through the back side. At least one spherical element may be selectively supported in the socket. The second opening may be smaller than the first opening and the spherical element may be exposed through each of the first and second openings. Thus, the spherical element may be engageable on a subject body through the first opening, and the spherical element may be engageable by a digit of a user through the second opening. To this end, the second opening may have a width and/or length dimension in a range from approximately one quarter inch to approximately one and a half inches. A snap ring may be supported in the first portion to retain the spherical element in the socket.

In still another simple form, a massage tool in accordance with the present invention may include a handle, a head supported on the handle, and a socket comprising an interior surface in the head. A retaining mechanism may include an annular or penannular groove in the interior surface. An annular or penannular resilient snap ring may be supported in the groove in a relaxed state.

Similar to that described above, the head may include a back side and a front side. The interior surface may include a portion that forms a first opening that opens outwardly through the front side in a direction opposite to the back side. The massage tool may further include a friction reducing pad connected to the backside on the interior surface. The friction reducing pad may include an o-ring. Alternatively, the friction reducing pad may include a sleeve. The backside may have a wall forming a second opening extending from the interior surface to an exterior surface of the head. The second opening may be smaller than the first opening. In one form, the second opening may be sized and configured to permit insertion of a human finger. Alternatively, a push button may be slidably supported in the second opening and span the second opening between the interior surface and the exterior surface.

A method of delivering a massage in accordance with the present invention may include selecting one spherical element of a plurality of spherical elements, removably placing the one spherical element in a socket of a massage tool, and rollably engaging a subject body with the one spherical element.

The method of delivering a massage may include a preliminary step of providing the plurality of spherical elements with a respective variety of physical characteristics. The step of providing may include providing a variety of physical characteristics by a variety of stones The step of selecting may include selecting the spherical element based on a desired physical characteristic. The step of selecting may include matching the one spherical element with a correlated desired effect associated with a particular stone in the variety.

In one form, the spherical elements may include a plurality of precious or semi precious stones. The stones may be associated with a variety of astrological signs. The step of selecting may include selecting the one stone based on an associated astrological sign. Alternatively or additionally, the method may include engendering a desired aspect of well being to the subject by the step of rollably engaging a subject body. In this regard, the step of engendering a desired aspect of well being may include selecting the one spherical element based on associated properties of the one spherical element that promote the aspect of well being during the step of selecting.

The method of delivering a massage may include removing the spherical element by a single pressing action by a digit of the user. This pressing action may include directly or indirectly engaging a backside of the spherical element with the digit of the user.

The foregoing and other features and advantages of the present invention will be apparent from the following more detailed description of the particular embodiments of the invention, as illustrated in the accompanying drawings.

BRIEF DESCRIPTION OF THE DRAWINGS

FIG. 13 is an exemplary table showing a list of materials and associated properties and astrological signs; and FIG. 14 is a diagrammatic view showing a set of spherical elements of varying physical characteristics.

DETAILED DESCRIPTION OF EMBODIMENTS OF THE INVENTION

Figure 1:
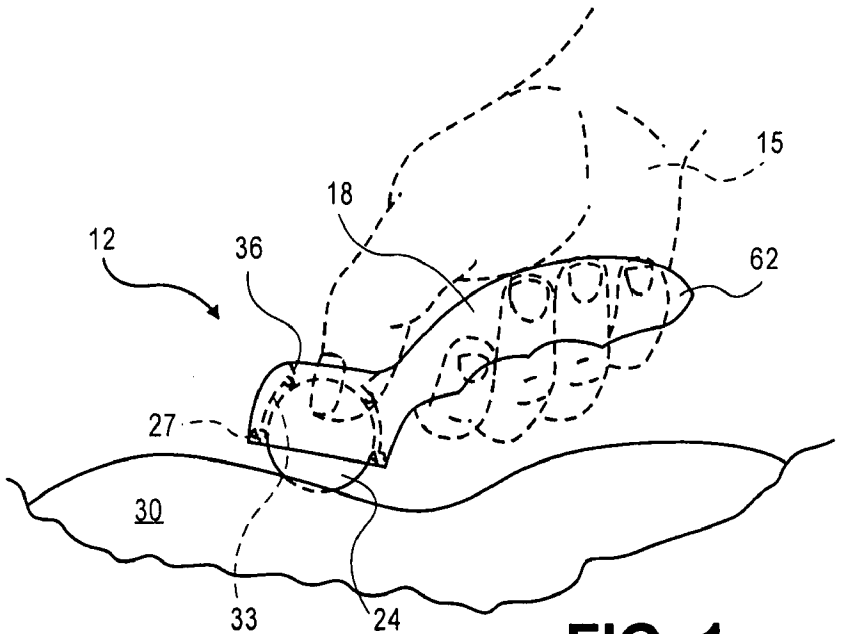
FIG. 1 is an exemplary side view of a massage tool as it may be used in accordance with an embodiment of the present invention.

As discussed above, embodiments of the present invention relate to massage tools and methods in general, and more specifically to handheld massage tools and methods for imparting an improved rolling massage. As shown in FIG. 1, a massage tool 12 of the present invention may be grasped by a hand 15 of a user. The massage tool 12 may have a body including a handle portion 18 and a head portion 21. A spherical element or roller ball 24 may be held in the head portion 21 by a snap ring 27 or other retaining mechanism. The roller ball 24 may be rotatively held in the head portion 21 so that a user may rollably engage a body 30 of a subject person in order to give the subject person a special roller therapeutic massage.

As shown in FIG. 1, the head portion may have an inner surface 33 forming a socket for receiving the roller ball 24. The roller ball 24 may protrude from a first opening 45 in order to rollably engage the body 30. The inner surface may also include a second opening 36 extending through the head portion 21 on a side opposite to the first opening 45. This second opening 36 may be small enough to prevent the roller ball 24 from passing completely through, yet large enough to permit passage of a thumb or finger of a user through to the roller ball 24. Thus, a user may engage the roller ball 24 with a thumb or finger in order to selectively press out and remove the ball 24 as will be described in greater detail below.

The massage tool 12 may be a handheld massage tool as shown in FIG. 1. As such, the massage tool 12 with its handle and head portions 18, 21 respectively may function as an extension of the hand 15 of the user. However, the hand tool aspect of the massage tool 12 may advantageously enable the user to apply greater forces and/or pressures than he/she would without a tool or without the extension of the handle and head portions 18, 21. Additionally, the massage tool 12 may provide the advantage of increased control and enable increased motion. Furthermore, the massage tool 12 may enable a beneficial rolling action by the ball 24 as opposed to friction.

Figure 2:
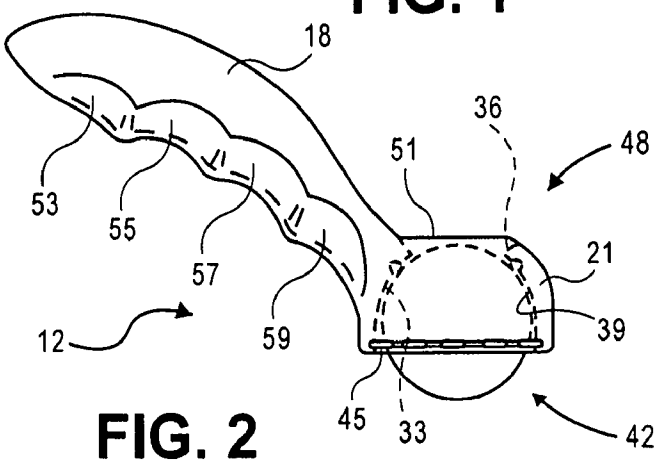
FIG. 2 is another side view of the massage tool of FIG. 1.

As more clearly shown in FIG. 2, the interior surface 33 forms a socket 39 that opens outwardly through a front side 42 by way of the first opening 45. The interior surface 33 may also includes a portion 36 that opens out through a backside 48 of the head portion 21 through a second opening 51. The handle portion 18 may include an ergonomic contour with finger placement depressions 53, 55, 57, and 59. All or part of the handle portion 18 may be covered with a soft resilient and/or elastomeric material for increased comfort and to enable more secure gripping by the user.

A handle tip 62 at an end of the handle portion 18 opposite to the head portion 21 may be somewhat pointed. This handle tip may be at least partially rounded or egg shaped with a small radius of curvature in order to apply greater pressure with minimal force applied by the user. Thus, the handle tip 62 may be used as a touch point for applying increased pressure to particular points on the subject body 30. The user may do so with his or her hand 15 in the position shown in FIG. 1. Alternatively or additionally, the user may reverse his or her grip so that the tip 62 extends generally between a thumb and forefinger. In this way, the user may apply a more focused and controlled pressure on particular muscles to provide cause an acupressure effect with subsequent increased relaxation.

Figure 3:
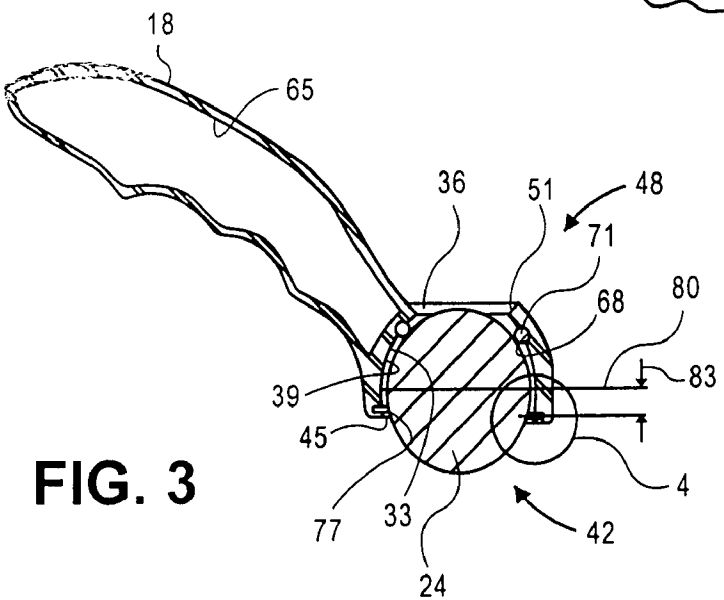
FIG. 3 is a sectional view taken through a center of the massage tool of FIG. 2 in a plane parallel to the page of FIG. 2.

FIG. 3 is a sectional view taken through a center of the massage tool in a plane parallel to the page of drawing FIGS. 1 and 2. As shown, the handle portion 18 may be hollow with an interior handle surface 65. Also shown more clearly in FIG. 3 is the second opening 51 that opens outwardly through the backside 48 of the head portion 21. The socket 39 may generally follow a contour of the ball 24 in the upper half of the head portion 21. The interior surface 33 may also include one or more recess or groove 68 in which may be disposed one or more respective friction reducing elements 71. In the embodiment shown in FIGS. 1 through 3, the recess or groove 68 may be an annular groove and the friction reducing element may be a single O-ring of a friction reducing material such as Teflon. The friction reducing element 71 may be configured to be received and held in the groove 68. Alternatively or additionally, the friction reducing element(s) may be adhered to the interior surface 33 or otherwise held at any of a variety of positions on the interior surface 33. In particular, the friction reducing element(s) may be placed to support the roller ball 24 and resist reaction forces generally in a direction of arrow 74 during a massage. The friction reducing element(s) and/or other socket structure may also rollably support the roller ball 24 against other forces that may be transverse to the direction of arrow 74.

As may be appreciated, the second opening 51 may be smaller than the first opening 45 and may thus prevent movement of the roller ball 24 out of the socket 39 toward a backside 48 of the head portion 21. On the other hand, the roller ball 24 may be inhibited against inadvertent exiting from the socket 39 through the first opening 45 by a snap ring 77 in a lower half of the socket 39 as shown in FIG. 3. The interior surface 33 that forms the socket 39 may extend from a widest dimension toward the first opening 45 generally along a straight cylindrical portion of the surface 33. Thus, the roller ball 24 may be uninhibited by the interior surface 33, and only retained by a retaining mechanism toward the front side 42. The retaining mechanism, including the snap ring 77, may be as is illustrated in greater detail in the detailed sectional view of FIG. 4, which corresponds with a region 4 of FIG. 3. It should be noted that in this exemplary embodiment, the ball 24 will be retained against inadvertent falling out as long as a center of the ball 24 lies on a plane 80 above the snap ring 77. As shown in FIG. 3, the center of the ball 24 lies at a distance 83 above a center of the snap ring 77.

Figure 4:
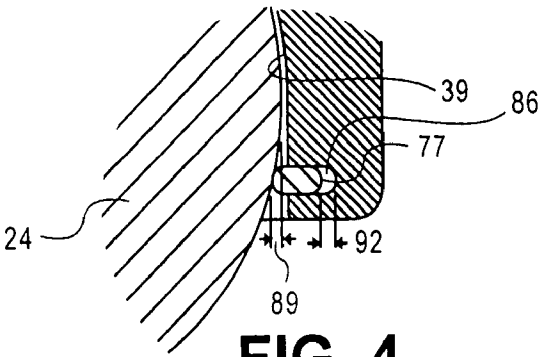
FIG. 4 is a detailed sectional view of a region 4 of FIG. 3.

As shown in FIG. 4, the snap ring 77 may be supported in a groove 86 that has at least a slightly larger dimension than the snap ring 77 in its relaxed state. As shown, the snap ring 77 may engage and inhibit the ball 24 from falling out of the socket 39 under the influence of gravity. As may be appreciated from FIGS. 1–4, the roller ball 24 may be held in close proximity to the friction reducing element(s) 71 by the snap ring 77. When it is desired to remove the roller ball 24 from the socket 39, the snap ring 77 may be forced further into the groove 86 through a distance 89 so that the minimum diameter of the snap ring 77 has been expanded to at least the maximum diameter of the roller ball 24. This may be accomplished most easily by simply forcing the roller ball 24 out of the socket 39 past the snap ring 77, thus expanding the snap ring 77 as the ball passes. As may be appreciated, the groove 86 for receiving the snap ring 77 may reach a depth corresponding to a distance 92 that extends beyond the maximum diameter of the snap ring 77 in its relaxed state. This depth may be sufficient to enable complete retraction of the snap ring 77 into the groove 86.

Figure 5:
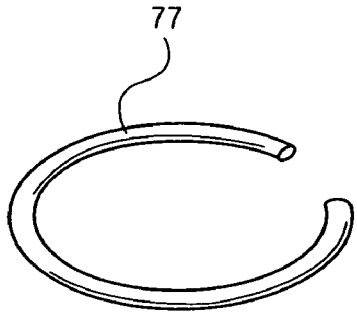
FIG. 5 is a perspective view of a snap ring according to the embodiment of FIGS. 1–4.

The groove 86 may be a complete annulus that extends completely around an interior of the cylindrical portion of the socket 39. The snap ring 77 may be an annular ring or an O-ring comprising a resilient or flexible material that can be contracted and expanded. This flexibility may facilitate installation of the snap ring into and removal of the snap ring from the groove. Furthermore, this flexibility and/or resiliency may enable the snap ring to retract outwardly into the groove 86 in an expanded state, and to protract inwardly to engage the roller ball in a relaxed state. Alternatively, one or both of the groove 86 and snap ring 77 may be substituted by one or more elements that extend less than a complete circle about the ball and socket. For example, a plurality of recesses could be substituted for the annular groove 86. Such plurality of recesses could support a respective plurality of expandable/contractible elements that would normally engage and inhibit the ball 24 from leaving the socket in their expanded state. On the other hand in a simple form, the snap ring 77 may be a penannular ring, as shown in FIG. 5. That is, the snap ring 77 may extend less than a 360 degrees arc. Thus, the snap ring 77 may be collapsed without overlapping on itself when installing the snap ring 77 into the groove 86. When the snap ring is aligned properly with the groove 86 it may expand from a collapsed state into the groove 86 and be supported therein in the relaxed state.

Figure 6:
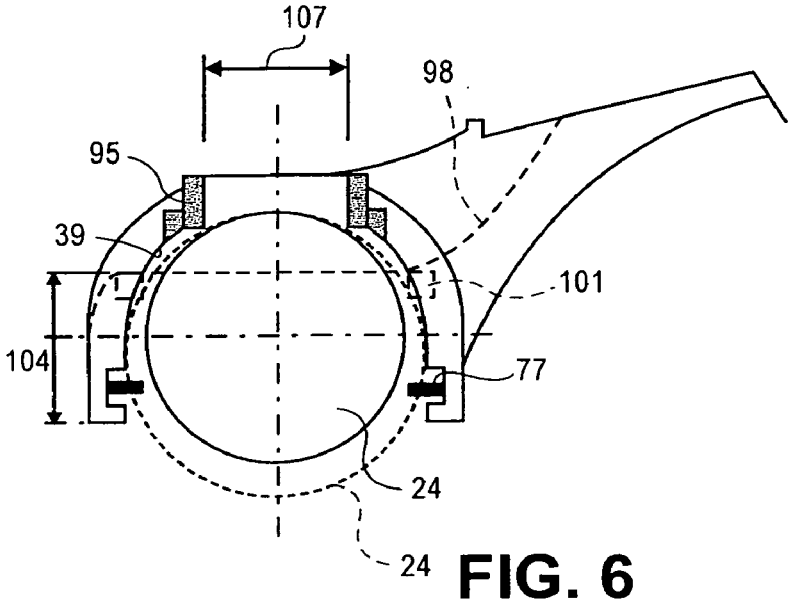
FIG. 6 is a diagrammatic sectional view of a portion of a massage tool showing variations that may be applied to the massage tool of FIGS. 1–5.

FIG. 6 shows some variations that may be applied to the embodiment of FIGS. 1 through 5 described above. For example, the ball 24 may he of any of a variety of sizes within a predetermined range, as represented by a smaller ball 24 and a larger ball 24 shown in dashed lines. The socket 39 and ring 77 may be provided of a size and expandability that enables receipt and retention of balls of the range of sizes. For example, the ball 24 may have a diameter of 40 millimeters (+/−) 0.13 millimeters. Alternatively expressed, the ball may vary in diameter by 0.02 inches. While these size variations are rather modest, it is to be understood that a set of balls 24 may be formed to a target size anywhere in a range from approximately one to approximately four inches in diameter in one possible range of sizes. Another target size for a set of balls 24 may be in a range from approximately five eighths inch to approximately two inches. The diameters in a set of roller balls 24 may vary from a particular target diameter in ranges from one thirty-second inch to one half inch among the roller balls of the set. The massage tool of FIG. 6 may be generally similar to that described with regard to FIGS. 1–5 above, but may be adapted to receive a particular size or range of sizes of roller balls 24. An alternative or additional friction reducing mechanism is shown in FIG. 6. The friction reducing mechanism shown in FIG. 6 may include one or more sleeve(s) 95 received in mating recess(es) in an upper portion of the socket 39. As shown, the sleeve may comprise a T-shaped configuration. This arrangement may be advantageous because the sleeve(s) 95 may form a friction fit within the recess(es) and thus facilitate assembly and retention of the sleeve(s) 95 in the recess(es) during and after assembly of the massage tool.

A further alternative and/or additional feature shown in FIG. 6 is shown by a dashed line 98 and may be provided by removing a portion of the backside of the head portion for a lower profile socket. In this embodiment, a larger portion of the roller ball 24 may extend upwardly through the second opening. Friction reducing element(s) 101 may be positioned to slidably support the roller ball 24 against movement in a direction outwardly of the second opening similar to that described above. Furthermore, a snap ring retaining mechanism similar to that which has been described above may be applied to hold the roller ball 24 in the low profile socket. The retaining mechanism may be provided with a low profile in order to further reduce a dimension 104. Thus, a massage tool may be provided with a relatively narrow ring socket surrounding a roller ball 24 and inhibiting movement of the roller ball 24 out of the narrow ring socket in both opposite openings of the narrow ring socket. The roller ball 24 may still be inserted by forcing the ball past the snap ring 77 and removed by engaging the backside of the roller ball 24 in the same manner as described above. It is to be understood that in selecting a height of the socket 39, the second opening indicated by dimension 107 will generally become larger as the head portion is made to be of an increasingly lower profile. In practice of the embodiments of FIGS. 1 through 6, it may generally be sufficient that the second opening be large enough to receive a finger or thumb of the user in order to engage the ball 24 and push it out of the socket after use, for heating the roller ball, and/or for cleaning of the roller ball 24 or tool.

Figure 7:
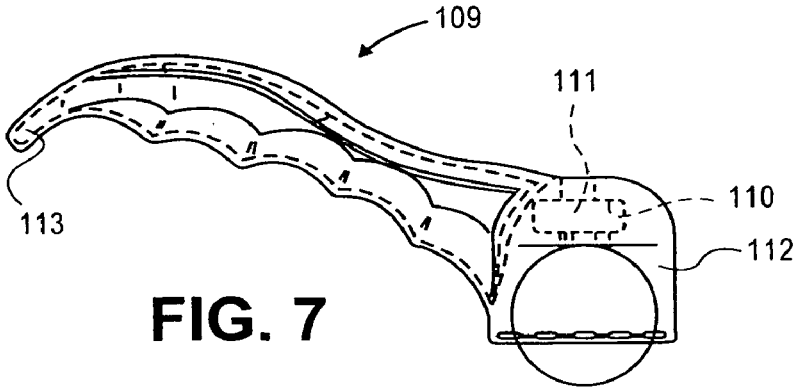
FIG. 7 is a side view similar to the side view of FIG. 2 and showing a massage tool in accordance with another embodiment of the present invention.

FIG. 7 is a side view (similar to FIG. 2) of a handheld massage tool 109 in accordance with another embodiment of the present invention. The handheld massage tool 109 is similar to the embodiment of FIGS. 1–6 described above. However, the second opening in the hand tool 109 may include a button recess 110 for slidably receiving a button 111 as shown in a sectional view of FIG. 8 taken through a center of the tool 109 on a plane parallel to the page of FIG. 7 (similar to the sectional view of FIG. 3). Thus, in this embodiment, a head portion 112 may be of a higher profile than the head portion for the embodiments described above.

Figure 8:
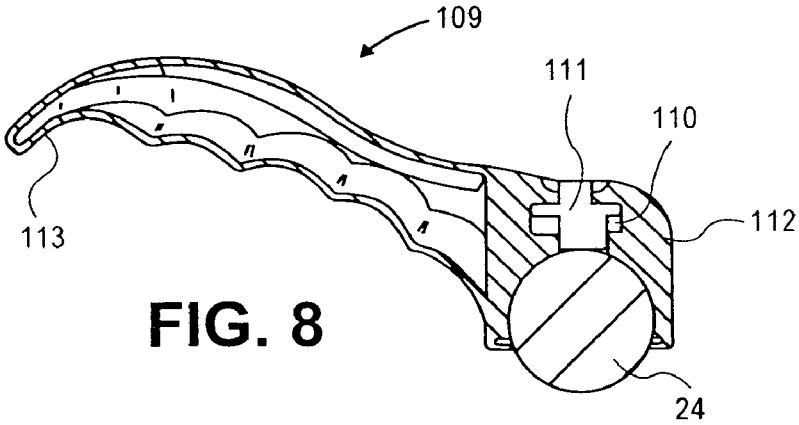
FIG. 8 is a sectional view similar to the sectional view of FIG. 3 and showing the massage tool in accordance with the embodiment of FIG. 7.

As shown in FIG. 8, when the ball 24 is held in the socket by the retaining mechanism in a position of use, the button 111 will be held in a retracted position. When it is desired to force the ball 24 from the socket, a user may engage the button 111 with his or her thumb or finger and press the button to a protracted position. A user may, by this action, thus force the ball 24 from the socket in a manner similar to that described above in which the user's thumb or finger engages the ball directly. The massage tool 109 of FIGS. 7 and 8 may also include an extended touch point tip 113 with a sharper configuration than the touch point tip described with regard to FIGS. 1–5 above.

Figure 9:
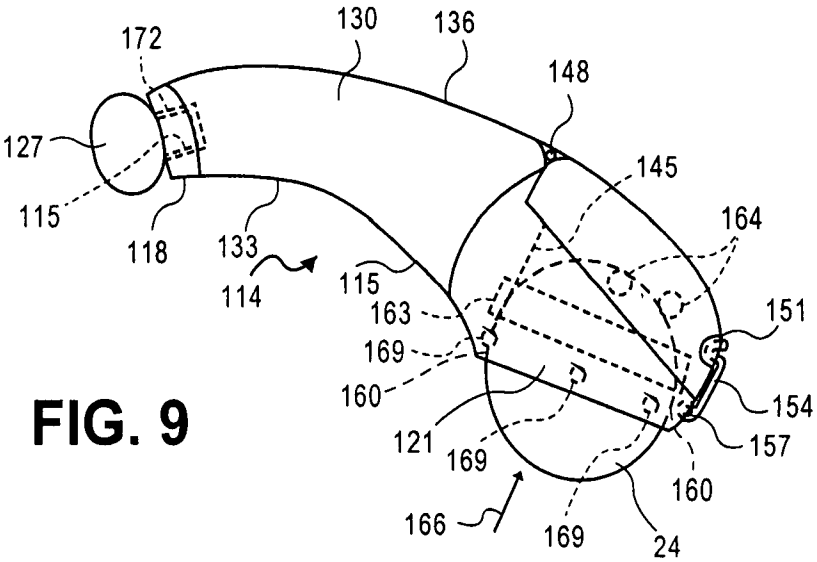
FIG. 9 is a diagrammatic side view of a massage tool in accordance with still another embodiment of the present invention.

FIG. 9 is a diagrammatic side view of a handheld massage tool 114 in accordance with another embodiment of the present invention. The tool 114 may have a main body in the form of a shank 115. The shank may have a proximal end 118 and a distal end 121. A roller in the form of the roller ball 24 may be rotatively supported in the distal end 121. A knob 127 may be removably or permanently supported on the proximal end 118 of the shank. A central portion of the shank may include a handle 130. The handle 130 may include a rubberized or elastomeric layer of material to add comfort and increased gripability of the shank 115. The shank 115 in general, and the handle in particular, may be shaped and sized in a manner that advantageously provides an ergonomic user interface. As may be appreciated, the handle 130 may be gripped by the user's hand with the thumb extending toward the distal end 121, or the handle may be gripped with the user's thumb extending toward the second end 118. Furthermore, the user's hand may engage the handle 130 with the thumb and index finger straddling the handle 130 from a concave lower surface 133, a convex upper surface 136, or from any direction in between. Because of its ergonomic configuration, the handle 130 will be comfortable to grasp in any orientation.

The shank 115 may have a lid 142 for opening and closing a socket 145 within the first end 121 of the shank. To this end, the lid may be pivotally mounted by a hinge 148 that may be recessed in the main body of the shank 115 for improved esthetics and ergonomics. The lid 142 may also have a notch 151 for lockingly receiving a latch 154. The latch 154 may be pivotally supported on the first end of the shank 115 by a pin 157 or the like. The latch 154 may be a resilient latch that can be engaged by the user's fingers to resiliently pry it out of the notch 151. It is to be understood that any of a number of other latches or other locking mechanisms may be substituted for the latch 154 without departing from the spirit and scope of the invention. Furthermore, it is to be understood that the latch may be supported on the lid, and the locking notch may be disposed in the first end 121 of the shank.

As shown, the socket 145 may be sized to receive the roller ball 24 therein. Thus, the lid 142 may be opened for inserting and removing the ball 24. The ball 24 may be permitted to reach a bottom of the socket 145 under the influence of gravity when the massage tool is generally in a position of use shown in FIG. 9. The bottom of the socket is formed by a constricted region 160 which forms an opening through the distal end 121 of the shank 115. The constricted region 160 may be provided with an inner dimension that is smaller than the rest of the socket 145 and smaller than the diameter of the roller ball 24 so that the roller ball 24 is able to fall to the bottom of the socket and yet be inhibited from falling out of the socket through the opening formed by the restricted region 160. Once the roller ball 24 is positioned in the bottom of the socket, the lid 142 may be closed and locked so that the roller ball 24 is inhibited from falling out of the socket in the opposite direction. As may be appreciated, the lid 142 may be configured to provide a positive stop that generally holds the roller ball 24 against movement away from the restricted region 160 so that pressure may be applied by the roller ball 24 when the user engages the roller ball 24 on a person's body for the purpose of giving a massage.

One or more friction reducing elements may be provided on an interior of the first end of the shank 115. These friction reducing elements may be positioned in any number of configurations for the purpose of reducing friction between the roller ball 24 and the shank 115. For example, a ball bearing race 163 may be positioned in the first end 121 of the shank. The ball bearing race 163 may actually form part of the socket 145 for surrounding and engaging the roller 24 during use. For reducing friction on the roller ball 24 when a force in a direction indicated by arrow 166 is applied, friction reducing elements may be advantageously provided on an opposite surface of the roller ball 24 relative to the direction of force 166. Thus, the ball bearing race 163 may be inserted after the roller ball 24 has been placed in the socket and reached a bottom thereof. Additionally or alternatively, ball bearings 169 may be mounted in the lid 142 or in other locations for rollably engaging the roller ball 24. These ball bearings 169 may be provided in races or in individual sockets. Further alternatively or additionally, other friction reducing elements may be provided. For example, slippery pads such as those formed of Teflon may be positioned to slidably engage the roller ball 24 in its normal position of use.

Thus, the massage tool 114, as well as the massage tools of the other embodiments disclosed herein, may be used as an extension of the user's hands, but wherein the roller ball 24 may be caused to engage a person's body in a rolling manner that progressively and smoothly moves across the body to provide a massaging pressure thereto. The resulting massage may be similar to a Petrissage or an Effleurage. However, the stroke enabled by the roller ball 24 and the shank 130, (or other massage tool body), acting as an extension of the user's hands and arms, advantageously provides a unique sensation to the person receiving the massage. Furthermore, using the massage tools of the present invention reduces stress on the user's hands and arms, as well as his or her shoulders. The user is able to apply a relatively focused or concentrated pressure through the roller ball 24 in a smooth progressive manner without having to apply a large force to the handle.

The knob 127 may be provided in any number of sizes and shapes. However, the knob 127 may be provided as a rounded knob having a radius of curvature in a range from approximately ¼ inch to approximately 1½ inches. The knob 127 may have a radius of curvature in a range from approximately ½ inch to approximately 1 inches. This range may be advantageously applied to limit the sharp uncomfortable feeling that may be experienced by the person receiving the massage while keeping the knob 127 small enough that the pressures applied through the knob may still be relatively high. In one configuration the knob may have a radius of curvature of ¾ of an inch. The purpose of the knob 127 is to trigger a response in the muscles of the person receiving the massage. Thus, the knob 127 may be termed a trigger point tip. One or more knobs 127 may be removably supported in a socket 172 and held therein by a detent 175, for example. The one or more knobs 127 may include a set of knobs having a variety of sizes, shapes, texture, and/or heat conductive properties. Thus the knob 127 may be selected for a particular desired effect during a massage.

Either or both the knobs 127 and the roller balls 24 may be heated prior to installation in the shank 115 of the tool 114 so that the massage may include application of heat in addition to more or less penetrating strokes on an area to be massage. Additionally, aromatic oils may be applied to a person's skin for engagement by the roller ball 24 and/or the knob 127 during a massage. Thus, additional health promoting sensations may be advantageously incorporated together with the other features of the present invention. Applying oils in this manner may also have the advantage of lubricating the roller ball 24 as well as the skin of the person receiving the massage.

While the particular radiuses of curvature, removability of knob 127, heating, and use with aromatic or other oils has been described with regard to the embodiment of FIG. 9, it is to be understood that these radiuses, removability, and practices may be applied for similar advantages with the embodiments of FIGS. 1–8 without departing from the spirit and scope of the invention.

Figure 10:
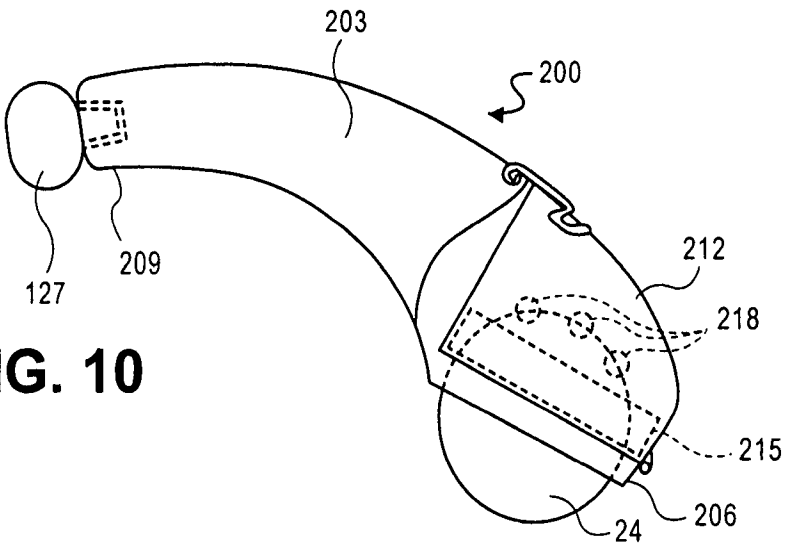
FIG. 10 is a diagrammatic side view of a massage tool in accordance with yet another embodiment of the present invention.

FIG. 10 is diagrammatic side view of a massage tool 200 in accordance with still another embodiment of the present invention. The massage tool 200 has a shank 103 with a first end 106 and a second end 109 that are analogous to those described with regard to the embodiment of FIG. 9 above. Any and all of the features described in other exemplary embodiments of this application may be equally applied to the embodiment of FIG. 10. Similarly, the unique features of the massage tool 200 of FIG. 10 may be applied to any other embodiment shown and described herein. In particular, the shank 103 of the massage tool 200 may have a lid 212 configured to open in a direction opposite to the lid shown and described with respect to FIG. 9. In this case, the lid may support friction reducing elements such as a ball bearing race 215 and/or other ball bearings 218 as shown. When the friction reducing elements are supported in the lid 212, the roller ball may be inserted in the socket and the lid 212 may be closed without the additional step of inserting the ball bearing race 215, for example. Otherwise, the socket of the massage tool 200 in FIG. 10 may have structure and function similar to those shown and described with regard to FIGS. 1–9 above. Likewise, the knob 127 in FIG. 10 may be substantially similar in structure and function to that shown in FIG. 9.

Figure 11:
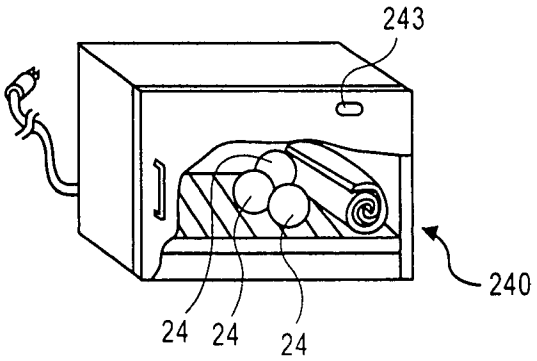
FIG. 11 is a perspective view of a heating device that may be used in conjunction with the massage tool and associated spherical elements.

FIG. 11 is a perspective view of a heating cabinet 240 that may be used for heating one or more roller balls 24 and/or knobs 127 as desired. A switch 243 may be a three position switched for providing temperatures of 135 F degrees, 175 F degrees, and off. Other temperatures or ranges of temperatures may be used in heating the roller balls and knobs of the present invention with similar advantages. For example, the heating cabinet may provide heating in a range from 90 F to 120 F. Alternative devices may be used to heat the roller balls 24 and/or knobs 127. For example, a crock pot or roaster may be used to heat the roller balls 24 and/or knobs 127. A microwave oven or other similar device may be used for fast efficient heating of roller balls and/or knobs of some materials. Use of moisture or water with any of these heating devices may facilitate heat transfer or provide heating by steam. Heat sources may include an electric grid, induction heating, conduction, convection, and/or radiative heating mechanisms. Any of these heating devices may additionally be used to heat moist or dry towels that may also be used during the massage.

Figure 12:
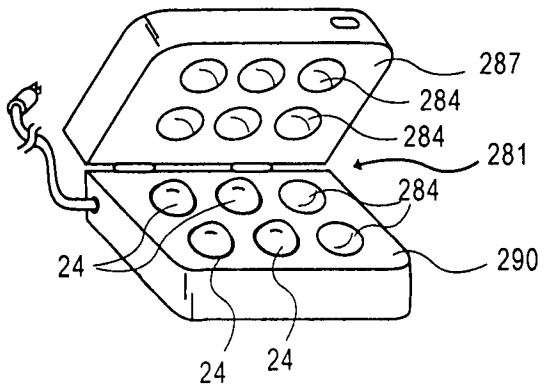
FIG. 12 is a perspective view of an alternative heating device that may be used in place of or in addition to the heating device of FIG. 11.

As shown in FIG. 12 a ball heater 281 may be provided. This ball heater 281 may have recesses 284 in upper and/or lower panels 287, 290 that may be hinged together in a clam shell arrangement. The roller ball heater may include a heating element for selectively heating one or more of the roller balls.

FIG. 13 shows a table 300 listing a variety of ball materials and corresponding characteristics and/or properties which these materials may have. In this table 300, the materials for the roller ball 24 refer to precious or semiprecious stones. Less costly stones such as marble may also be used. As indicated by the break line 303 this list is exemplary only, and the list could be extended indefinitely. Furthermore, the list of materials for the roller balls may include any of a variety of other materials including nonprecious natural or manmade stone, metals, plastics, ceramics, glasses, composites, or other materials not yet discovered.

Just as certain compounds discovered over the ages have proven to be medicinal when applied with skill to people and animals, it is now being discovered that certain materials with their respective properties can induce increased health or well being when used with skill. Materials, with their respective compositions including molecular structure, have a variety of physical properties that respond to and/or emit electrical, magnetic, and/or energy fields in a variety of different ways. Each of the stones listed in the first column of table 300 has several basic physical characteristics such as particular densities, crystalline structures, colors, heat capacitances, electrical, and/or magnetic properties. Perhaps related to these physical characteristics and the ways in which the listed stones respond and/or emit fields, these stones also have associated metaphysical and healing properties as indicated in the second and third columns of table 300. Furthermore, the fourth column of table 300 shows astrological signs that have been associated with respective stones in the list.

In accordance with a method of the present invention, a user may selectively place a spherical element of a particular material in a socket of a massage tool of the present invention in order to provide a massage to a body of a subject person. The spherical element may comprise a particular semiprecious or precious stone. And the stone may be selected to impart the benefits associated with that stone to the subject body. This aspect of the method may have utility at more than one level. For example, at a minimum, if a person receiving a massage puts a measure of credence in the association of particular metaphysical properties or healing properties with a respective stone shown in the table, then the use of that stone during his or her massage will provide increased meaning in receiving the massage for the subject person. Similarly, by utilizing a stone associated with a particular astrological sign, the subject person receiving the massage may associate some significant additional meaning to the massage. Thus, the method of associating metaphysical properties, healing properties, and/or astrological signs with a roller ball to be used in a massage according to the present invention has the practical utility of adding meaning to a particular massage for the subject person receiving the massage. Thus, the method may include the utility of meeting a need for subject persons who desire the metaphysical or healing properties or the associated well-being that they hope will be derived therefrom. Therefore, this aspect of the present invention has utility in providing subject persons with that meaning.

On the other hand, many recipients of massages or other treatments that utilize the stones listed in table 300 (and others) have concluded from their experience that these stones do indeed impart or facilitate the associated well-being and/or healing that is listed. Accordingly, it may be argued that while science may not yet have a way to identify or measure causal links between use of particular materials and the beneficial results, these beneficial results are recognized by those who believe that the associated properties of particular materials really facilitate healing or increased well-being.

FIG. 14 thus shows a set of roller balls 306 that may vary in size, material, and other physical characteristics in accordance with this aspect of the invention. It is to be understood that in accordance with the present invention, a particular roller ball may be selected for the metaphysical properties or healing properties as set forth in the table of FIG. 13, or to provide some other desired effect based on the size or makeup of the particular roller ball. For example, roller balls of smaller diameter will impart a greater pressure than roller balls of a larger diameter when each is engaged by the same force on a subject body. Thus, it is within the spirit and scope of the invention to selectively choose a particular roller ball from among a set 306 of roller balls for the purpose of imparting the benefits associated with that particular roller ball to a subject person's body. The opportunity to select from among a set of roller balls having distinct characteristics and properties in conjunction with the rolling aspect of the roller balls when supported in the sockets of the massage tools of the present invention advantageously provide a massage that promotes relaxation, healing, and well being as well as being uniquely enjoyable.

A method in accordance with the present invention may include asking or otherwise testing a body of a subject person to determine a personal preference, body characteristic, or other fact. Based on the answer to the inquiry or test results, the user may then select at least one spherical element that correlates to the one or more answers or results. Thus, the treatment of a prospective massage recipient may be adapted to particular body makeup and/or other needs of the recipient. Testing for this purpose may include testing by and/or for electrical, chemical, magnetic, energy, or other flows in a body of a subject person and measuring a response or reaction. Then the user may better decide to select one or more spherical elements for a correlated property or quality that can advantageously engender a desired benefit to the subject person.

It is to be understood that the methods of the present invention may be implemented with any of the massage tools described herein. Furthermore, the principle of providing the roller balls of a variety of semiprecious stones may be expanded to encompass any of a variety of materials or combinations of materials for the respective characteristics, properties, and/or benefits associated therewith.

For example, it is to be understood that the roller ball 24 may be formed of a single solid material such as a hard plastic similar to the material of which bowling balls are made. Alternatively, the roller ball may be formed of solid metal. Further alternatively, the ball may have a hard core formed of a heat conductive material such as steel or other metals. Still further alternatively, the core may be formed of a heat conductive plastic or cementitious material. Advantageously, the core may be exceedingly hard in order to provide the penetrating effect desired by the user. In order to soften the feel of the roller ball 24, a layer of softer material may be provided on the core. The layer may also reduce the rate at which heat is conducted out of the core and into the flesh of the person receiving the massage. On the other hand, if high heat conduction and a deeper harder penetration is desired, the layer may be formed of a heat conductive incompressible material. As may be appreciated, the characteristics of this material may be selected to provide any desired combination of heat conduction and hardness. It is also to be understood that the core may be selected so as to retain its heat for a long period of time. This characteristic may be achieved to some degree by providing the core as a solid ball in order to provide the maximum mass for a particular material. If lower mass is desired, the core may be provided as a hollow core with an interior surface. Further alternatively, the hollow core may be filled with a liquid or other material.

The roller balls 24 may be provided in a variety of configurations. For example, one roller ball may be provided with a relatively thin layer of material as described above. This layer may also be color coated for facilitating recognition of the roller ball as the hardest roller ball of a set. For example, the roller ball may black in color, while a roller ball having medium hardness may be colored blue. Another roller ball may be the least hard of the set and may be colored green. The hardness of the roller balls may be attributable to a thickness of their respective outer layers. This would be true if each of the balls included a similarly softer material in their respective outer layers than that of their respective cores. There are other ways in which the hardness of the roller balls may be varied. For example, the roller balls may be provided of materials having different overall resiliency, for example. The coloration of the balls may be provided by paint or dyes within the material of which the roller balls are made. In any case, a set of roller balls including color coated balls of different hardnesses and/or heat conductive or heat capacitive characteristics may be advantageously provided.

Alternatively or additionally, the roller balls 24 may be provided with a variety of textures for imparting a variety of different sensations on the body of the subject person.

Any of a variety of additional features may be implemented with the embodiments of the present invention. For example, it is contemplated that the roller balls and/or knobs of the present invention may incorporate magnets for the purpose of including their health promoting properties during a massage, for example. Furthermore, magnets may be implemented for holding the knobs and/or the rollers in their respective positions of use. Magnetic holding mechanisms of this type would provide the advantage of enabling easy removal while otherwise holding the knobs or rollers in place against inadvertent falling out in their normal use conditions.

The massage tools of the present invention have the particular advantage of enabling rotation of the roller balls about more than one axis. In fact, the roller balls of the present invention are capable of rotating about multiple axes. Furthermore, the ball and socket arrangement of the roller balls of the various embodiments herein enable rotation of the roller balls about a continuously changing axis of rotation. That is, during a massage, the user may choose any of a variety of patterns of stroke. These patterns and strokes may be achieved with little or no frictional aspect in the massage. On the other hand, the knobs of the present invention may be used for friction type massaging.

The embodiments and examples set forth herein have been presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

We claim:

1. A massage tool comprising:

a handle;

a head supported on the handle;

a socket comprising an interior surface in the head; and a retaining mechanism comprising:

an annular or penannular groove in the interior surface; and an annular or penannular resilient snap ring supported in the groove in a relaxed state;

wherein:

the head comprises a back side and a front side;

the interior surface comprises a portion that forms a first opening that opens outwardly through the front side in a direction opposite to the back side; and the massage tool further comprising a friction reducing pad connected to the backside on the interior surface.

2. The massage tool of claim 1, wherein the friction reducing pad comprises an o-ring.

3. The massage tool of claim 1, wherein the friction reducing pad comprises a sleeve.

4. The massage tool of claim 1, wherein the backside has a wall forming a second opening extending from the interior surface to an exterior surface of the head.

5. The massage tool of claim 4, wherein:

the second opening is smaller than the first opening; and the second opening is sized and configured to permit insertion of a human finger.

6. The massage tool of claim 4, further comprising a push button slidably supported in the second opening and spanning the second opening between the interior surface and the exterior surface.

* * * * *